US005245934A

United States Patent [19]

Dodson

[11] Patent Number: 5,245,934

[45] Date of Patent: Sep. 21, 1993

[54] HEATING MATTER

[75] Inventor: Christopher E. Dodson, Reading, England

[73] Assignee: Mortimer Technology Holdings Ltd., Reading, England

[21] Appl. No.: 821,866

[22] PCT Filed: Jun. 1, 1989

[86] PCT No.: PCT/GB89/00603

§ 371 Date: Nov. 29, 1990

§ 102(e) Date: Nov. 29, 1990

[87] PCT Pub. No.: WO89/12202

PCT Pub. Date: Dec. 14, 1989

Related U.S. Application Data

[63] Continuation of Ser. No. 613,567, Nov. 29, 1990, abandoned.

[30] Foreign Application Priority Data

Jun. 8, 1988 [GB] United Kingdom ..... 8813530

[51] Int. Cl.[5] ..... F23D 19/02

[52] U.S. Cl. ..... 110/245; 110/346; 110/347; 432/222; 431/170

[58] Field of Search ..... 110/248, 237, 245, 346, 110/347; 432/222; 431/170

[56] References Cited

U.S. PATENT DOCUMENTS

| | | | |
|---|---|---|---|
| 3,899,883 | 8/1975 | Stakic et al. | 60/261 |
| 4,268,248 | 5/1981 | Wilbur et al. | 432/222 |
| 4,276,864 | 7/1981 | Waschkuttis | 123/544 |
| 4,308,806 | 1/1982 | Uemura et al. | 110/346 |
| 4,359,861 | 11/1982 | Citelli | 60/39.37 |
| 4,392,814 | 7/1983 | Harding | 110/245 |
| 4,416,325 | 11/1983 | Barratt et al. | 110/254 |
| 4,476,791 | 10/1984 | Cegielski, Jr. | 110/237 |
| 4,498,909 | 2/1985 | Milner et al. | 110/248 |
| 4,687,491 | 8/1987 | Latty | 122/4 D |
| 4,726,767 | 2/1988 | Nakajima | 432/222 |
| 4,771,707 | 9/1988 | Robson et al. | 110/254 |
| 4,782,773 | 11/1988 | Takaoku et al. | 110/237 |
| 4,817,563 | 4/1989 | Beisswenger et al. | 110/245 |
| 4,842,509 | 6/1989 | Hasenack | 431/8 |
| 4,850,290 | 7/1989 | Benoit et al. | 110/237 |
| 4,909,811 | 3/1990 | Dodson | 55/92 |
| 5,002,481 | 3/1991 | Forster | 431/11 |
| 5,033,205 | 7/1991 | Dodson | 34/10 |

FOREIGN PATENT DOCUMENTS

| | | |
|---|---|---|
| 0068853 | 3/1987 | European Pat. Off. . |
| 2074889A | 11/1981 | United Kingdom . |
| 2126493 | 3/1984 | United Kingdom . |
| 2164951 | 4/1986 | United Kingdom . |
| 2202618 | 9/1988 | United Kingdom . |
| 2203670 | 10/1988 | United Kingdom . |
| 2205049 | 11/1988 | United Kingdom . |
| 2211597 | 7/1989 | United Kingdom . |

OTHER PUBLICATIONS

F. V. Tooley, The Handbook of Glass Manufacture, vol. 1 Books for Industry, pp. 228–229.

Gas Engineer's Handbook, 1st Ed., Industrial Press, Inc. pp. 2/71–2/72.

*Primary Examiner*—Henry C. Yuen

*Attorney, Agent, or Firm*—Watson, Cole, Grindle & Watson

[57] ABSTRACT

A method of heating matter comprises supplying a gaseous mixture, which is reactable to produce heat, at a temperature above that at which spontaneous ignition occurs to a heating zone such that the gaseous mixture reacts to provide a heated fluid flow in said heating zone, and supplying matter to be heated to said heating zone.

15 Claims, 5 Drawing Sheets

HEATING MATTER

This application is a continuation of application Ser. No. 613,567, filed Nov. 29, 1990, now abandoned.

BACKGROUND OF THE INVENTION

This invention relates to heating matter and is particularly, but not exclusively, applicable to methods of heating matter using apparatus as disclosed in Specification EP-B-68853 and copending British Specifications Nos. 2202618A, 2203670A, 2205049A and 2211597A, and in which matter is moved in a band continuously along an annular path in an annular zone by directing fluid flow into the zone over the annular extent thereof with both circumferential and vertical flow components. It will be understood that by utilising heated fluid for the fluid flow over at least a portion of the annular extent of the zone, there will be a heat transfer between the heated fluid and matter as the heated fluid passes through the band thereby heating the matter.

A gaseous mixture which is reactable to produce heat may be used to provide a heated fluid flow, for example the gaseous mixture may be a combustible gaseous mixture, typically comprising an air-gaseous fuel mixture.

However it will be understood that, for the above process of producing a heated fluid flow to be efficient in a method of heating matter as described above wherein the heated fluid flow passes through a band of the matter which is moving continuously along an annular path in an annular zone, the reaction which produces the heated fluid flow should occur in the zone and must be rapid to ensure that the reaction is substantially completed within the extent of the band, which for example is typically 50 mm deep.

SUMMARY OF THE INVENTION

We have found that the required rapid reaction can be achieved by supplying the gaseous mixture at a temperature above that at which fuel dissociation occurs, such that spontaneous ignition occurs and no flame front exists.

The invention in its broadest aspect includes a method of heating matter comprising supplying a gaseous mixture, which is reactable to produce heat, at a temperature above that at which spontaneous ignition occurs, to a heating zone such that the gaseous mixture reacts in said heating zone to provide a heated fluid flow therein, and supplying matter to be heated to said heating zone.

Advantageously the reaction utilised is a combustion reaction and the invention also includes a method of heating matter comprising supplying a combustible gaseous mixture at a temperature above that at which spontaneous ignition occurs to a heating zone such that a combustion reaction occurs in said heating zone to provide a heated fluid flow therein and supplying matter to be heated to said heating zone.

Furthermore, in presently preferred embodiments a combustible air-gaseous fuel mixture is utilised and the invention further includes a method of heating matter comprising supplying a combustible air-gaseous fuel mixture at a temperature above that at which spontaneous ignition of the gaseous fuel occurs to a heating zone such that a combustion reaction occurs in said heating zone to provide a heated fluid flow therein, and supplying said matter to said heating zone.

Although the invention is applicable to other methods of heating matter, it is especially applicable to the above-described method, in which case the matter to be heated is moved in a band continuously along an annular path in an annular zone by directing fluid flow into said zone over the annular extent thereof with both circumferential and vertical flow components, said fluid flow comprising said gaseous mixture over at least a portion of the annular extent of said zone, and the reaction thereof being substantially completed within the extent of said band.

The fluid flow may comprise said gaseous mixture over the annular extent of said zone.

The matter may comprise particulate material which forms a resident bed moving in said band along said annular path.

The gaseous mixture may be directed into a first annular region of said annular zone, which region is contiguous with and disposed inwardly of a second annular region of said annular zone such that said reaction occurs substantially in said first annular region, and said matter is circulated between said regions whilst moving in said band.

In embodiments of the invention described hereinafter the gaseous mixture comprises an airgaseous fuel mixture and the fluid flow is directed into said annular zone through an annular inlet comprising an annular array of fixed inclined vanes arranged in overlapping relationship, said gaseous fuel being mixed with heated air immediately upstream of respective passages defined between said vanes and combustion occurring downstream of said vanes.

Preferably the air-gaseous fuel mixture is confined substantially to the region above the vanes by directing respective flows through said annular inlet at the radially inner and outer edges thereof with radially outwardly and radially inwardly flow components respectively.

The gaseous fuel may comprise natural gas, and in an embodiment of the invention an air-natural gas mixture is supplied at a temperature greater than 700° C. The temperature of this mixture is obtained by mixing the natural gas with heated air at a temperature of less than about 1000° C., for example between 850° and 900° C.

In order that the invention may be better understood, some embodiments thereof will now be described, reference being had to the accompanying drawings:

DETAILED DESCRIPTION OF THE PREFERRED EMBODIMENTS

Figure 1:
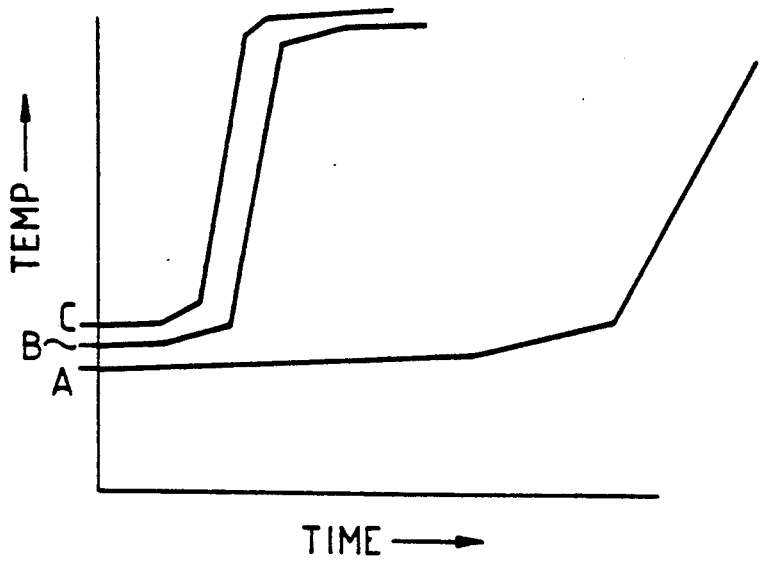
FIG. 1 is a graph showing the effect of the temperature of an air-gaseous fuel mixture on combustion rate.

Referring first to FIG. 1, the effect of the temperature of a combustible air-gaseous fuel mixture prior to combustion on the rate of combustion is indicated. It will be noted that combustion of the mixture at the lowest temperature A is comparatively slower than combustion of the mixture at higher temperatures B and C, the temperature/time curves in the latter cases being substantially J-shaped, the temperature generated by the combustion rising rapidly soon after combustion commences. In the embodiments of the present invention described hereinafter an air gaseous fuel mixture is provided for combustion at a temperature above that at which dissociation of the fuel occurs so that rapid combustion is achieved.

Figure 2:
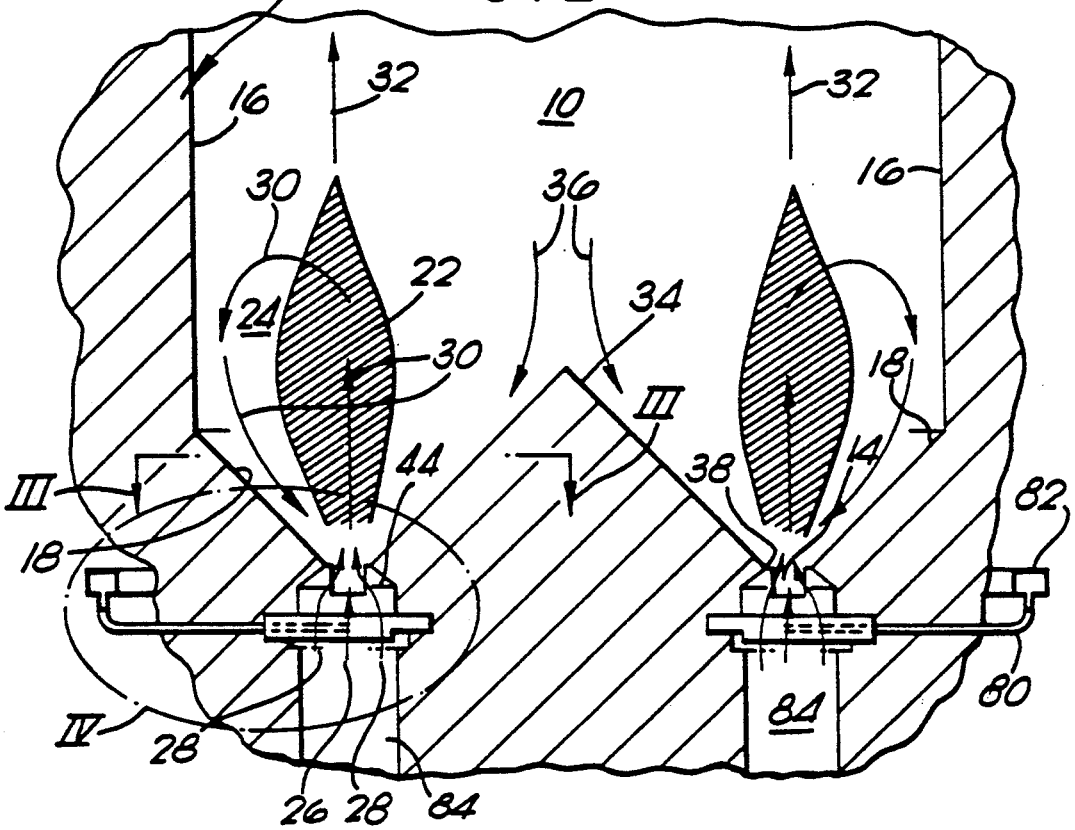
FIG. 2 is a schematic axial cross-section of an apparatus for heating matter.
Figure 3:
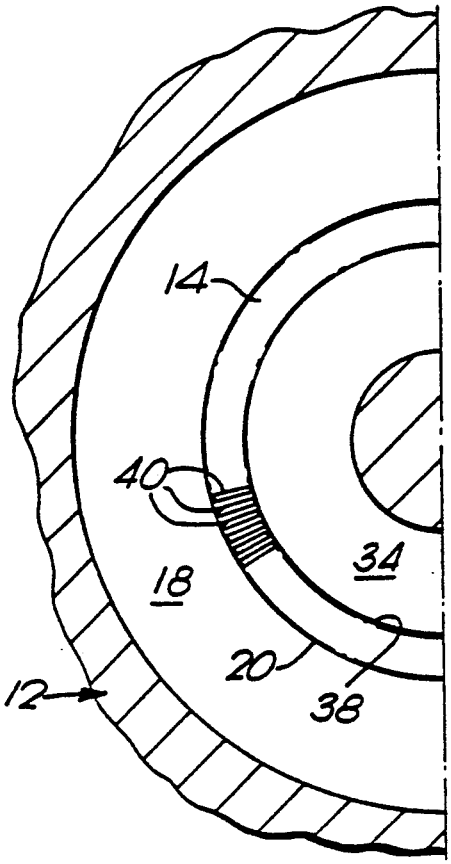
FIG. 3 is a cross-section along the line III—III of FIG. 2.
Figure 4:
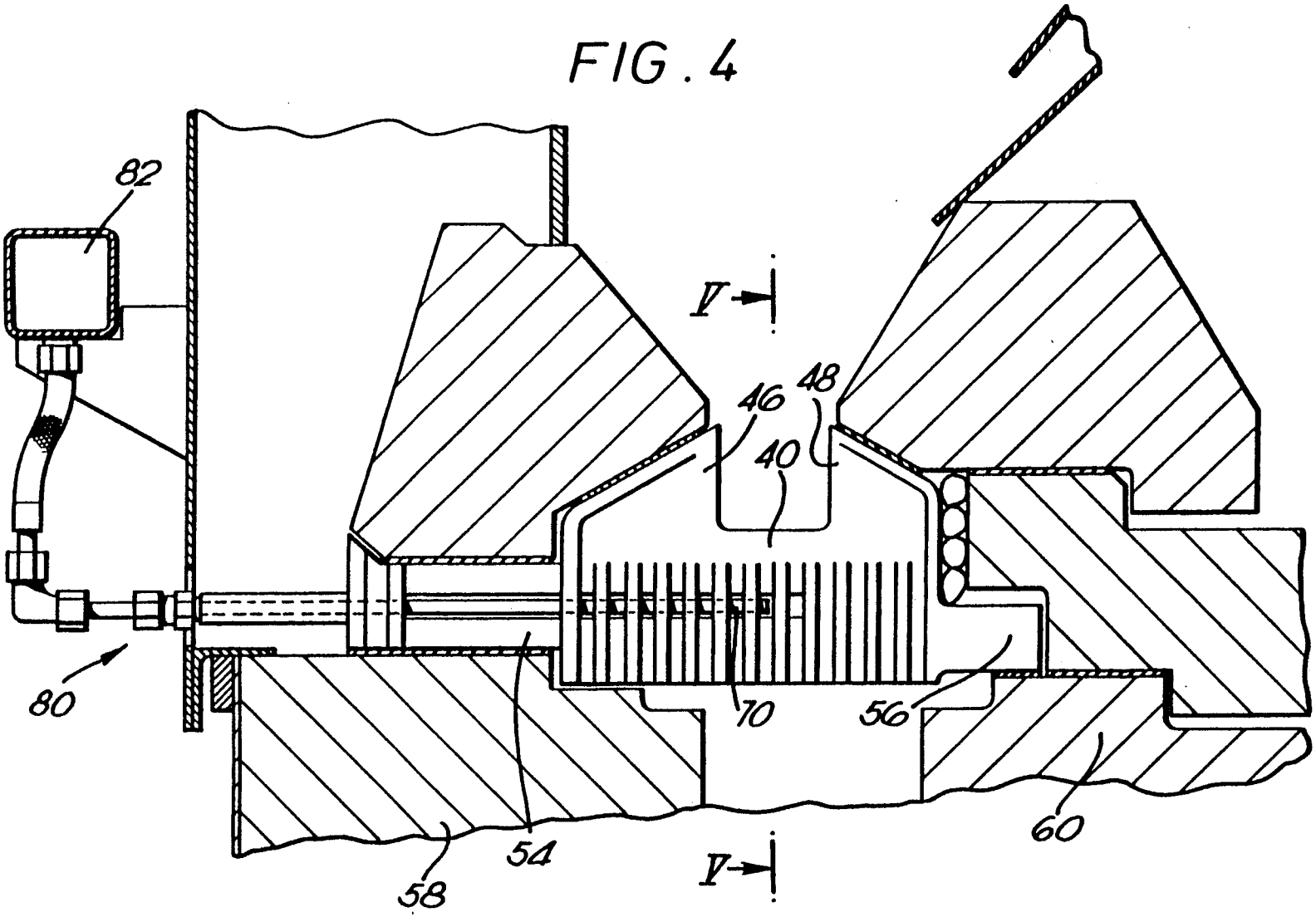
FIG. 4 shows the portion indicated by IV in FIG. 2 to a larger scale and in more detail than in FIG. 2.

Referring now to FIGS. 2 and 3, the illustrated apparatus comprises a chamber 10 having a circumferential wall 12 which is disposed radially outwardly of an annular inlet 14. The wall 12 slopes towards the annular inlet, and as shown comprises a cylindrical portion 16 extending upwardly from a portion 18. In the illustrated apparatus, the sloping portion 18 extends downwardly to the outer edge of the annular fluid inlet.

Within the chamber 10 there is a first annular region disposed above the annular inlet and designated 22 in FIG. 2 and a second annular region contiguous with the first annular region and disposed between that region and the circumferential wall 12. The second region is disposed above the sloping portion 18 of the wall in the embodiment.

The apparatus also includes means for directing fluid through the annular inlet 14 with vertical and circumferential flow components. The direction of the fluid flow through the inlet is indicated in FIG. 2 by arrows 26 and 28. The flow of fluid through the inlet is such that it will move matter in the chamber 10 in a band continuously along an annular path in the regions 22, 24. This matter is moved vertically, and circumferentially whilst in the first region 22 by the flow of fluid therein, is moved out of this flow of fluid in the first region into the second region by circumferential force and is directed back into the first region by the slope 18. The movement of the matter into and out of the flow of fluid is indicated by arrows 30 in FIG. 2. It will be understood that whilst the matter is being circulated as indicated by arrows 30, it is also moving in the circumferential direction. Furthermore, it will be understood that when the matter moves into the outer annular region 24, it is not subjected therein to the flow of fluid and falls under gravity towards the annular inlet 14, whereupon it re-enters the fluid flow and is moved circumferentially and vertically by the fluid flow therein.

The fluid exits the chamber 10 upwardly as indicated by arrows 32 after it has passed through the annular region 22.

In the illustrated apparatus the chamber 10 includes a second circumferential wall 34 extending upwardly and disposed radially inwardly of the annular fluid inlet 14. This circumferential wall 34 has a slope towards the annular fluid inlet such that matter introduced centrally into the chamber as indicated by arrows 36 will be directed into the first annular region 22 above the annular fluid inlet 14. Whilst the whole of the second circumferential wall is provided with such a slope in the embodiment and this slope extends to the radially inner edge 38 of the annular fluid inlet 14, it is to be understood that only a portion of the circumferential wall 34 need be provided with such a slope and that slope need not extend to the edge 38.

Referring now particularly to FIGS. 4 to 7, the means for directing fluid through the annular inlet 14 with vertical and circumferential flow components in the illustrated apparatus comprises an annular array of fixed inclined vanes 40 arranged in overlapping relationship, and defining therebetween respective flow passages 42 which extend vertically and circumferentially. A portion of the annular array of vanes is schematically illustrated in FIG. 3; however, it is to be understood that the array extends completely around the annular inlet 14.

Figure 7:
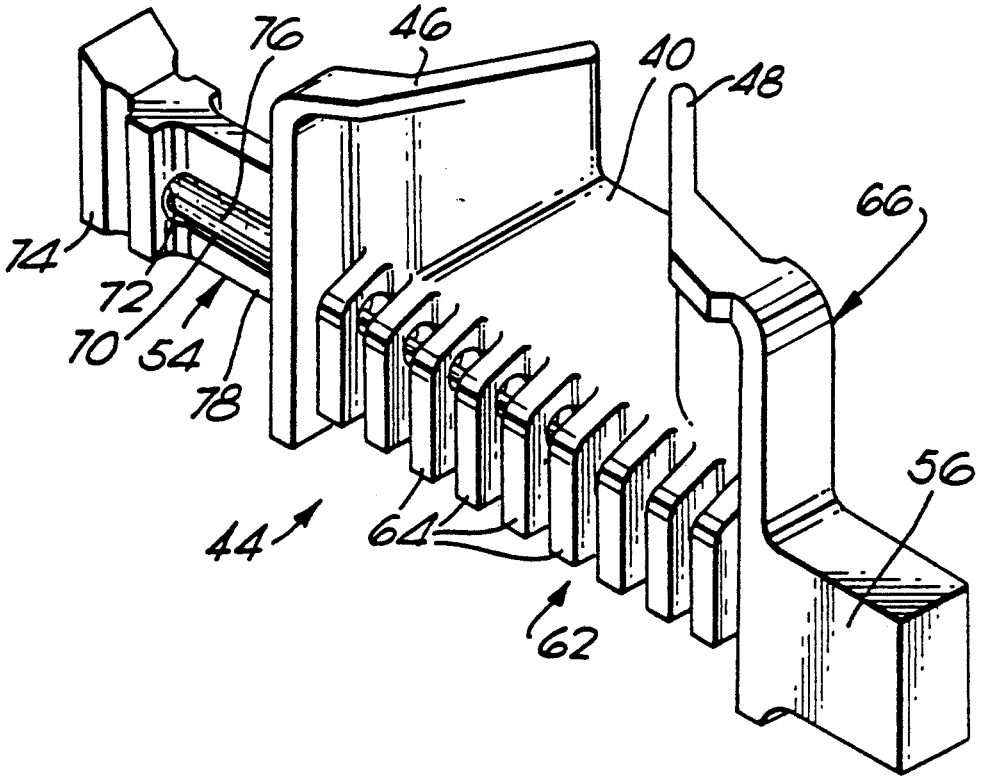
FIG. 7 is a perspective view of a single blade of the apparatus.
Figure 6:
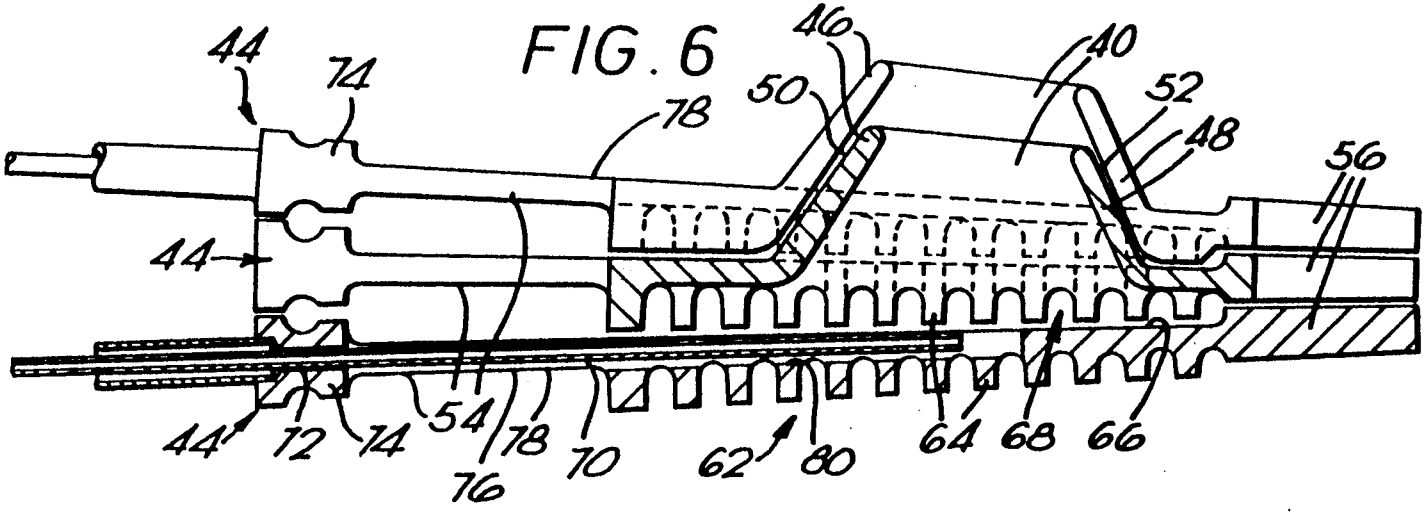
FIG. 6 is a top, part section view of three blades of the apparatus.
Figure 5:
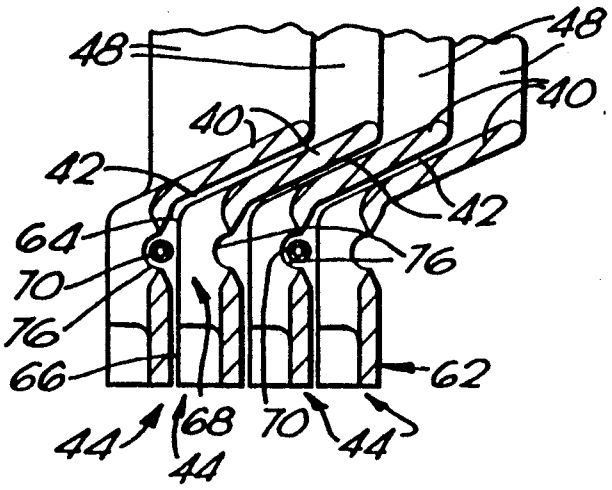
FIG. 5 is a section taken along the line V—V in FIG. 4 showing four blades of the apparatus.

Each vane 40 is part of a respective blade 44 which is best shown in FIG. 7. Adjacent blades 44 nest together as illustrated in FIGS. 5 and 6 so as to dispose the vanes in overlapping relationship with the passages therebetween. Each blade 44 is also provided with respective side vanes 46 and 48 extending upwardly from radially outer and radially inner sides of its vane 40. The side vanes 46 and 48 of the blades overlap to define therebetween respective flow passages 50 and 52. The vanes 46 and 48 are inclined towards each other and the flows through the passages 50 and 52 at the radially outer and inner edges of the inlet 14, indicated by arrows 28 in FIG. 2, have radially inwardly and radially outwardly flow components, respectively, causing the flow through the passages 42, indicated by arrow 26 in FIG. 2, to be confined substantially to the annular region 22 above the vanes 40.

The blades are provided with radially outer and radially inner mounting portions 54 and 56, by which they are mounted on annular ledges 58 and 60 respectively radially outwardly and radially inwardly of the annular inlet 14. Intermediate the mounting portions the blades are provided with a ribbed portion 62 which extends vertically to the upstream ends of the vanes 40, 46 and 48. The ribs 64 of the portion 62; extend vertically and are provided on only one side of the portion 62 in the illustrated blade and define with the plain opposite side 66 of the portion 62 of an adjacent blade vertically extending flow passage means 68 communicating with the flow passages 42, 50 and 52 defined between that blade and the adjacent blade. Each blade is provided with a passage for receiving a gaseous fuel distributor, or so-called 'sparge' pipe 70. This passage comprises a bore 72 in an enlarged free end portion 74 of the mounting portion 54 and a slot 76 aligned with the bore 72 and extending therefrom through the remaining portion 78 of the mounting portion 54 into the ribbed portion 62 and terminating short of the mounting portion 56. In the ribbed portion 62 the slot is completely open at the plain side 66 thereof but bridged at spaced apart locations by the ribs 64 at the other side.

As shown in FIGS. 5 and 6 a pipe 70 is received in the passage therefor in alternate blades 44, each pipe being provided with radial openings arranged to supply gaseous fluid to the flow passages defined by the blade in which the pipe is fitted and the blades on each side of that blade. The pipes 70 are all connected via conduit means 80 to an annular gas header tube, or manifold, 82 disposed externally of the circumferential wall 12 of the chamber.

In use heated air is caused to swirl about an annular chamber 84 beneath the annular inlet 14 and to flow through the passage means 68 defined between adjacent blades in the passages 42, 50 and 52 defined between the vanes of those blades. This air mixes with gaseous fuel from the pipes 70 to form a heated air-gaseous fuel mixture in the passage means 68 and this mixture is combusted in the annular region of 22 of the chamber 10 above the inlet 14. The air-gaseous fuel mixture is heated prior to combustion by the mixing of the gaseous fuel with the heated air to a temperature above that at which spontaneous ignition of the gaseous fuel occurs, such that a rapid combustion reaction occurs as explained hereinbefore in connection with FIG. 1. The rate of combustion is such that although the velocity of the air mixing with the fuel is greater than the flame propagation velocity thereof so that the resulting flow is able to move matter in a band along an annular path in the chamber 10, combustion occurs, and is substantially completed, within the extent of the band, that is, before the mixture passes through the matter in the band. Additionally, because the gaseous fuel is mixed with the air immediately upstream of the passages 42, most of the combustion occurs downstream of the blades 44, and accordingly they are not subjected to the full heat of the combustion reaction.

The above-described embodiment is particularly applicable for use in heating matter comprising a particulate material which has to be heated to a predetermined temperature which is at or below the temperature at which fast combustion reactions occur, or which is adversely affected by being continuously subjected to temperatures above that predetermined temperature during treatment.

In such an application the combustion reaction occurs substantially in the first annular region 22 in the chamber 10. The particulate matter to be heated is supplied to the chamber centrally thereof and is fed to the region 22 by the slope of the inner circumferential wall 34. This particulate material is then moved in a band continuously along an annular path in the regions 22 and 24. The particulate material is moved vertically and circumferentially by the fluid flow whilst in the first region, is moved out of the flow in the first region into the second region by circumferential force and is thereafter directed back into the first region by the slope 18 of the outer circumferential wall 12. Thus, the particulate material is moved in a band continuously around the regions 22, 24 whilst being circulated in this band between the regions, such that the material moves into and out of the heated flow during movement around the regions.

It will be appreciated that as the combustion reaction is maintained spaced from the walls 18 and 34 these are not raised to the temperature of the region 22 and therefore contact by the particulate matter of these walls does not adversely affect the matter.

Although the above-described embodiment is applicable to heating many types of particulate matter, particular examples of its application are the heating of perlite, slate and clay to expand the same.

Figure 9:
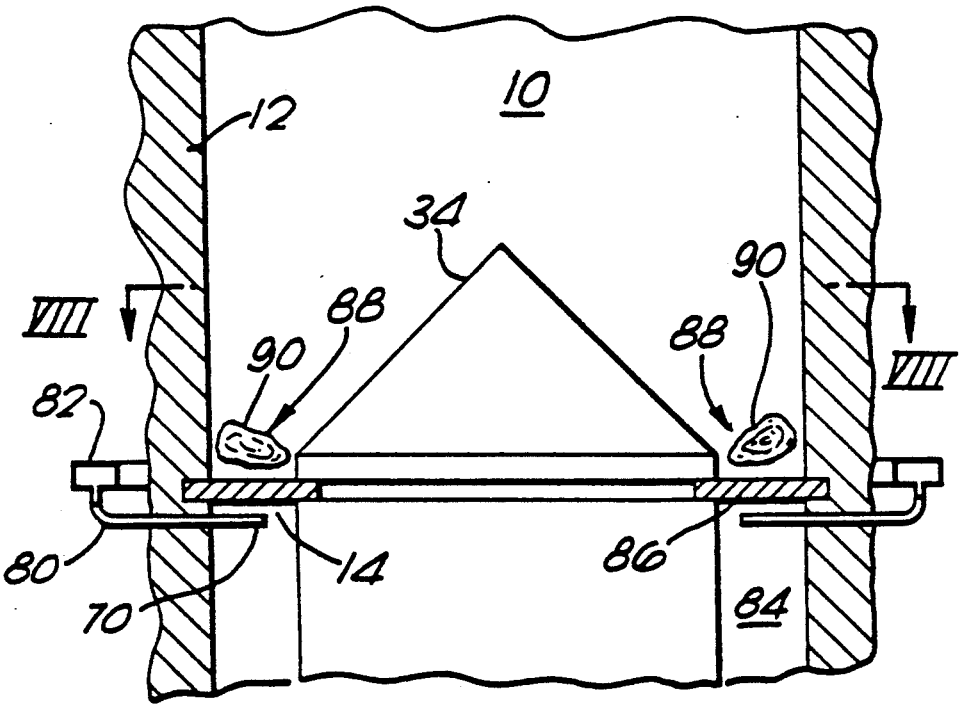
FIG. 9 is an axial cross-section of the same apparatus.
Figure 8:
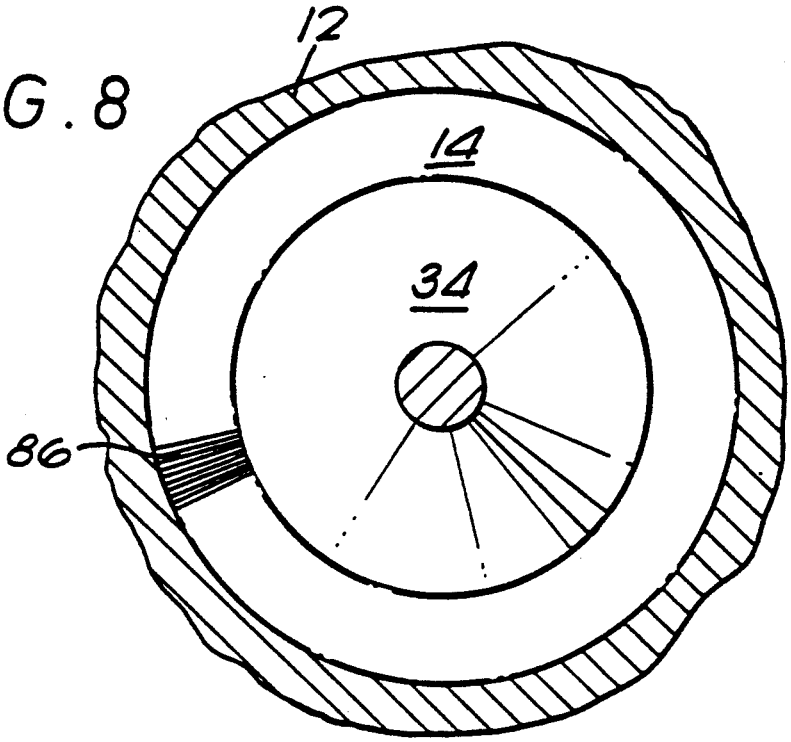
FIG. 8 is a schematic top plan view of another apparatus for heating matter taken along the line VIII—VIII of FIG. 9 taken along the line VIII—VIII of FIG. 9.

Referring now to FIGS. 8 and 9, there is illustrated an apparatus for heating matter which is similar to the apparatus illustrated in FIGS. 2 and 3. Accordingly, like reference numerals in these figures designate like or similar parts. The annular inlet 14 is spanned by an annular array of inclined vanes 86 (only a portion of the array being shown in FIG. 8) which are preferably arranged in overlapping relationship for directing fluid flow into the annular zone 88 above the inlet 14 with both circumferential and vertical flow components for moving a resident bed of particulate matter in the zone 88 continuously along an annular path in a compact band 90.

Heated air is caused to swirl about annular chamber 84 beneath the inlet 14 and to flow between the vanes 86 into the zone 88. This air mixes with gaseous fuel from fuel pipes 70 immediately upstream of the vanes to form a heated air-gaseous fuel mixture which is combined in zone 88. As in the previous embodiment, the heated mixture prior to combustion is at a temperature above that at which spontaneous ignition of the gaseous fuel occurs such that a rapid combustion occurs. The rate of combustion is such that combustion is substantially completed within the extent of the band of particulate matter forming the resident bed, thus efficiently heating that matter. Further matter to be heated is either added to the resident bed or passed therethrough such that heat is transferred to the further matter from the heated particulate matter of the bed. This further matter may comprise gases, liquids or solids.

In the case where the further matter to be heated is a gas, the heated air-gaseous fuel mixture is passed through the bed along a portion of the annular extent of the zone 88 to heat the bed and the gas is passed through the bed along another portion of the annular extent of the zone 88 to be heated by the matter in the bed.

One example of solid matter which may be heated by being added to the resident bed is fine powder.

The apparatus and method described above in connection with FIGS. 8 and 9 may be used to heat matter, especially particulate matter directly without the use of a resident bed. In this case it will be appreciated that the matter to be heated is introduced into the zone 88 and is moved continuously along an annular path in a compact band by the passage of the heated fluid flow provided by the combustion of the heated air-gaseous fuel mixture through the matter whilst heating it.

It is to be understood that an arrangement of nested blades with fuel sparge pipes fitted to alternate blades substantially as described in connection with FIGS. 4 to 7 ma be used in the apparatus shown in FIGS. 8 and 9 instead of the more simple overlapping vane arrangement schematically illustrated.

Although other gaseous fuels, such as propane, methane and vapourised oil, may be used, in the embodiments described above the gaseous fuel is natural gas and the air-natural gas mixture prior to combustion is at a temperature above 700° C. To obtain such a mixture temperature the air is preferably at a temperature of between 850° and 900° C. Other air temperatures may be used, but it has been found that at air temperatures above about 1000° C. carbon deposits are likely to form in the fuel pipes 70. Thus, it is advantageous to use an air temperature of less than about 1000° C.

Although the embodiments have been described utilising a heated air-gaseous fuel mixture to provide a heated flow, other combustible gaseous mixtures or gaseous mixtures which react to produce heated flow and whose reaction rate is typified by a substantially J-shaped temperature/time curve which the mixture prior to commencement of the reaction is at a temperature above that at which spontaneous ignition occurs may be used.

I claim:

1. A method of heating matter in a fluid-supported bed apparatus which provides a combustion chamber above a gas inlet so that a fluid-supported bed of matter can be formed in a region in the chamber above the gas inlet, said method including the steps of (a) mixing two mutually reactable gases and passing them through said gas inlet so as to form a heated fluid flow within said region, (b) adding matter to said region so as to be supported in a bed by said heated fluid flow and become heated, and (c) heating at least one of said two reactable gases prior to step (a) to a sufficiently high temperature that when said two reactable gases are mixed in step (a), spontaneous ignition will occur and no flame front in said region will be present.

2. A method as claimed in claim 1, wherein said apparatus includes an annular gas inlet and wherein the region thereabove is annular, and wherein the matter to be heated is moved in a band continuously along an annular path in said annular region by directing fluid flow into said region with both circumferential and vertical flow components, said fluid flow comprising said gaseous mixture over at least a portion of the annular extent of said region, and the reaction thereof being substantially completed within the extent of said band.

3. A method as claimed in claim 1, wherein said two mutually reactable gases are mutually combustible.

4. A method as claimed in claim 3, wherein said apparatus includes an annular gas inlet and wherein the region thereabove is annular, and wherein the matter to be heated is moved in a band continuously along an annular path in an annular region by directing fluid flow into said region with both circumferential and vertical flow components, said fluid flow comprising said gaseous mixture over at least a portion of the annular extent of said region, and the reaction thereof being substantially completed within the extent of said band.

5. A method according to claim 3, wherein said mutually combustible gases comprise air and a combustible gaseous fuel.

6. A method as claimed in claim 5, wherein said air is heated to said sufficiently high temperature.

7. A method as claimed in claim 5, wherein said apparatus includes an annular gas inlet and wherein the region thereabove is annular, and wherein the matter to be heated is moved in a band continuously along an annular path in said annular region by directing fluid flow through said gas inlet into said region with both circumferential and vertical flow components, said fluid flow comprising said gaseous mixture over at least a portion of the annular extent of said region, and the reaction thereof being substantially completed within the extent of said band.

8. A method as claimed in claim 7, wherein said fluid flow comprises said gaseous mixture over the annular extent of said zone.

9. A method as claimed in claim 8, wherein said heated fluid flow is directed into a first annular zone of said annular region, which zone is contiguous with and disposed inwardly of a second annular zone of said annular region such that said reaction occurs substantially in said first annular zone, and said matter is circulated between said zones whilst moving in said band.

10. A method as claimed in claim 7, wherein said matter comprises particulate material which forms a resident bed moving in said band along said annular path.

11. A method as claimed in claim 7, wherein said annular gas inlet is provided by an annular array of fixed inclined vanes, said gaseous fuel being mixed with heated air immediately upstream of respective passages defined between said vanes and wherein combustion occurs downstream of said vanes.

12. A method as claimed in claim 11, including confining said air-gaseous fuel mixture substantially to the region above the vanes by directing respective flows through said annular inlet at the radially inner and outer edges thereof with radially outwardly and radially inwardly flow components respectively.

13. A method as claimed in claim 11, wherein said gaseous fuel comprises natural gas and said mixture is supplied at a temperature greater than 700° C.

14. A method as claimed in claim 13, wherein said temperature of said mixture is obtained by mixing said natural gas with heated air at a temperature of less than about 1000° C.

15. A method as claimed in claim 14, wherein said air is at a temperature of between 850° C. and 900° C.

* * * * *